US006009182A

United States Patent [19]

Gunness

[11] Patent Number: 6,009,182

[45] Date of Patent: Dec. 28, 1999

[54] DOWN-FILL SPEAKER FOR LARGE SCALE SOUND REPRODUCTION SYSTEM

[75] Inventor: David W. Gunness, Sutton, Mass.

[73] Assignee: Eastern Acoustic Works, Inc., Whitinsville, Mass.

[21] Appl. No.: 08/921,185

[22] Filed: Aug. 29, 1997

[51] Int. Cl.[6] ..... H04R 1/02; H04R 1/20

[52] U.S. Cl. ..... 381/182; 381/340; 381/342

[58] Field of Search ..... 381/82, 340, 335, 381/332, 386, 339, 342, 351; 181/152, 159, 177, 179, 144, 145, 153

[56] References Cited

U.S. PATENT DOCUMENTS

| | | | |
|---|---|---|---|
| 4,174,019 | 11/1979 | Kramer . | |
| 4,308,932 | 1/1982 | Keele, Jr. . | |
| 4,369,857 | 1/1983 | Frazer et al. . | |
| 4,390,078 | 6/1983 | Howze et al. . | |
| 4,503,930 | 3/1985 | McDowell . | |
| 4,525,604 | 6/1985 | Frye . | |
| 4,685,532 | 8/1987 | Gunness . | |
| 4,805,730 | 2/1989 | O'Neill | 181/148 |
| 4,969,196 | 11/1990 | Nakamura . | |
| 4,982,436 | 1/1991 | Cowan . | |
| 5,000,286 | 3/1991 | Crawford et al. | 181/145 |
| 5,020,630 | 6/1991 | Gunness | 181/192 |
| 5,109,419 | 4/1992 | Griesinger . | |

*Primary Examiner*—Curtis A. Kuntz
*Assistant Examiner*—Rexford N Barnie
*Attorney, Agent, or Firm*—Haynes and Boone, L.L.P.

[57] ABSTRACT

A down-fill speaker for a large scale sound reproduction system is formed from a cabinet having generally rectangular and trapezoidal cross-sections along respective vertical and horizontal axes thereof. Upper and lower loudspeakers are supportably mounted in the cabinet in a generally vertical array and separated by a separator wall. The upper and lower loudspeakers each include a horn defined by walls of the cabinet. The upper horn is defined by interior side surfaces of top, first side and second side walls of the cabinet and a first interior side surface of the separator wall. The lower horn is defined by interior side surfaces of bottom, first side and second side walls of the cabinet and a second interior side surface of the separator wall. The separator wall is angled about 15 degrees below a horizontal axis for the speaker while the first and second interior side surfaces thereof have oppositely orientated tapers of generally equal magnitude. The interior side surface of the bottom wall is substantially parallel to the lower side surface of the separator wall along a first portion thereof and, along a second portion thereof, the interior side surface of the bottom wall is downwardly angled about 30 degrees relative to the interior side surface of the first portion. Acoustic signals generated by the upper loudspeaker and reflected off of the interior side surface of said top wall provide down-fill coverage for a first area while acoustic signals generated by the lower loudspeaker and reflected off of the second interior side surface of the separator wall provide down-fill coverage for a second area.

20 Claims, 2 Drawing Sheets

DOWN-FILL SPEAKER FOR LARGE SCALE SOUND REPRODUCTION SYSTEM

TECHNICAL FIELD

The invention relates generally to large scale sound reproduction systems and, more particularly, to a down-fill speaker which directs audible sound signals to a down-fill coverage area immediately forward of an elevated loudspeaker cluster forming part of the large scale sound reproduction system.

BACKGROUND OF THE INVENTION

Sound is a physical disturbance in the medium through which it propagates. For example, in air, sound consists of localized variations in pressure above and below normal atmospheric pressure. Accordingly, the vast majority of sound reproduction system s are comprised of electromagnetic transducers in which an electrical signal is transformed into a mechanical vibration which, in turn, is transformed into an acoustic signal. Sound reproduction systems typically include separate loudspeakers, each generating sound within a selected frequency range. For lower frequencies, i.e., frequencies below 300 Hz., loudspeakers are typically comprised of a diaphragm, most commonly, a relatively large cone, a support system in which the cone or other diaphragm is mounted and a driver which vibrates the cone in a desired fashion to produce sound waves are used. For higher frequencies, i.e., frequencies above 300 Hz., horn loudspeakers, which are characterized by a smaller cone or other type of driver and speaker walls, positioned forward of the cone, which follow a selected pattern are more common.

While sound reproduction systems have been the subject of numerous innovations over the years, pattern control of sound projection within a particular listening area has remained a problem. Effective pattern control is particularly problematic when the sound reproduction system is installed in a stadium or other large structure. While it would be very desirable to provide even sound levels throughout the stadium, various considerations has made such a goal quite difficult. One problem is the dramatic variation between the distance separating the closest and furthermost listeners from the stage. Specifically, while the closest listener may be just a few meters from the stage, the furthermost listener may be as far as 300 meters away. Thus, sound reproduction systems suitable for use in stadium and other large venues must be capable of throwing sound considerable distances. As sound levels for high frequency sounds tend to drop off dramatically over distance, in order for high frequency sounds to travel these distances, the initial sound levels produced by the sound reproduction system must be quite high. For this reason, many sound reproduction systems capable of generating desired audible sound levels at the furthermost reaches of the stadium inadvertently produce sound far in excess of the desired audible sound levels close to the stage.

A common sound reproduction system used in stadiums and other large venues is generally referred to as a cluster system. Cluster systems are generally characterized by high efficiency, middle and high frequency range speakers having sharp vertical and horizontal directivity and high-power low frequency range speakers. In a cluster system, speakers are concentrated in one or two locations within the stadium or other large venue. While the location of a cluster system within a stadium or other large venue will vary depending on the particular uses contemplated therefor, in order for the cluster system to throw sound the requisite distances, cluster systems are typically elevated on the order of about 20 to 30 feet above their surroundings.

The elevation of cluster systems causes other problems. One such problem is that much of the sound produced by the cluster system will miss those areas immediately in front of the cluster. More specifically, low frequency range sounds are generally omni-directional and can propagate into those areas immediately forward of the cluster systems. High frequency range sounds, however, are highly directionalized and tend to propagated away from the cluster system in defined "beams" of sound. As those areas which are in proximity to the cluster systems are outside of the beams of high frequency sounds propagating away from the elevated cluster system, high frequency sounds generated by elevated cluster systems typically miss a front portion of the listening area. The size of the missed front section tends to vary depending on elevation of the cluster, width of the beam and upward slope of the listening area.

To address this shortcoming, cluster systems will typically include one or more down-fill loudspeakers for directing high frequency range sounds to the front section of the listening area. Unlike the remainder of the cluster system, the down-fill loudspeakers are angled relative to the ground so that the beam is directed into the front section. While this approach is successful, it greatly complicates the task of elevating the cluster system. Specifically, rigging an elevated down-fill loudspeaker at a proper angle so that the sound beam generated thereby will be directed into the front section of the listening area is much more difficult a task than rigging the remainder of the cluster system. Other proposed solutions involve downwardly angling both the driver and horn relative to the surface plane such that the beam exits from a horn opening formed at least partially in a bottom side surface of the down-fill speaker. While such an approach makes it possible to position the down-fill speaker cabinet parallel to the surface plane, such loudspeakers have yet to be widely accepted by the industry. For example, tasks such as storage and transport are seen by many as more complicated if the loudspeaker has a horn opening which extends along two surfaces.

SUMMARY OF THE INVENTION

In one embodiment, the present invention is of a down-fill speaker which includes a cabinet and a loudspeaker, supportably mounted in the cabinet, configured to generate a high frequency acoustic signal having a vertical beam angle. Interior side surfaces of top, bottom, first side and second side walls of the cabinet define a horn for the loudspeaker. The vertical beam is greater than an angle of inclination for the top wall but less than an angle of declination for the bottom wall. A portion of the generated acoustic signal, therefore, will reflect off the interior side surface of the top wall to provide acoustical coverage for a down-fill area located below the beam angle.

In one aspect thereof, the top and bottom walls include respective front edges which are located in a common plane generally orthogonal to the top and bottom walls. In another, the interior side surfaces of the top and bottom walls are shaped to reflect the acoustical signal about 30 degrees below the vertical beam angle. In still another, the angle of inclination for the top wall is about −15 degrees and the angle of declination for the bottom wall is about 15 degrees along a first portion thereof and about 45 degrees along a second portion thereof.

In another embodiment, the present invention is of a down-fill speaker which includes a cabinet having a generally rectangular cross-section along a vertical axis thereof and in which at least one loudspeaker is supportably mounted. For each of the at least one loudspeaker, interior walls of the cabinet define a horn therefor. The interior walls are shaped to direct audible sound signals generated by the at least one loudspeaker at least about 15 degrees below a horizontal axis thereof by reflecting the audible sound signals off selected ones of the interior side surfaces.

In certain aspects thereof, the down-fill speaker includes first and second loudspeakers arranged in a vertical array. The interior walls of the cabinet may define a first horn for the first loudspeaker which is shaped to direct audible sound signals to a first down-fill coverage area and a second horn for the second loudspeaker which is shaped to direct audible sound signals to a second down-fill coverage area. In other aspects thereof, the first horn is separated from the second horn by a separator wall which may be angled at least about 15 degrees below the horizontal axis of the vertical array of loudspeakers and include a tapered top side surface which defines a bottom wall for the first horn and an oppositely tapered bottom side surface which defines a top wall for the second horn. In still others, the interior side surface of the walls further define a bottom wall for the second horn which is characterized by a first section generally parallel with the bottom side surface of the separator wall and a second section, approximately equal in length to the first section, angled approximately 30 degrees away from the bottom side surface of the separator wall.

In still another embodiment, the present invention is of a down-fill speaker which includes a cabinet having a generally rectangular cross-section along a vertical axis thereof and in which a loudspeaker is supportably mounted. The cabinet includes top, bottom, first side and second side walls which collectively define a horn for the loudspeaker. The horn is characterized by the top wall being generally parallel with, while the bottom wall is shifted down about 15 degrees relative to a common horizontal axis. As acoustic signals above the horizontal axis are reflected off of the interior side surface of the top wall, the loudspeaker provides down-fill coverage below the horizontal axis. In one aspect thereof, the horn is further characterized by the interior side surfaces of the top and bottom walls have oppositely orientated tapers of generally equal magnitude.

In a further embodiment, the present invention is again directed to a down-fill speaker which includes a cabinet having a generally rectangular cross-section along a vertical axis thereof and in which a loudspeaker is supportably mounted. As before, the cabinet includes top, bottom, first side and second side walls which collectively define a horn for the loudspeaker. In this embodiment, however, the horn is characterized by the interior side surfaces of the top and bottom walls being substantially parallel to each other along a first portion of the bottom wall and, along a second portion of the bottom wall, the interior side surface being downwardly angled about 30 degrees relative to the interior side surface of the first portion of the bottom wall. Down-fill coverage for the loudspeaker is provided by acoustic signals which are generated by the loudspeaker and reflected off of the interior side surface of the top wall.

DESCRIPTION OF A PREFERRED EMBODIMENT

Figure 1:
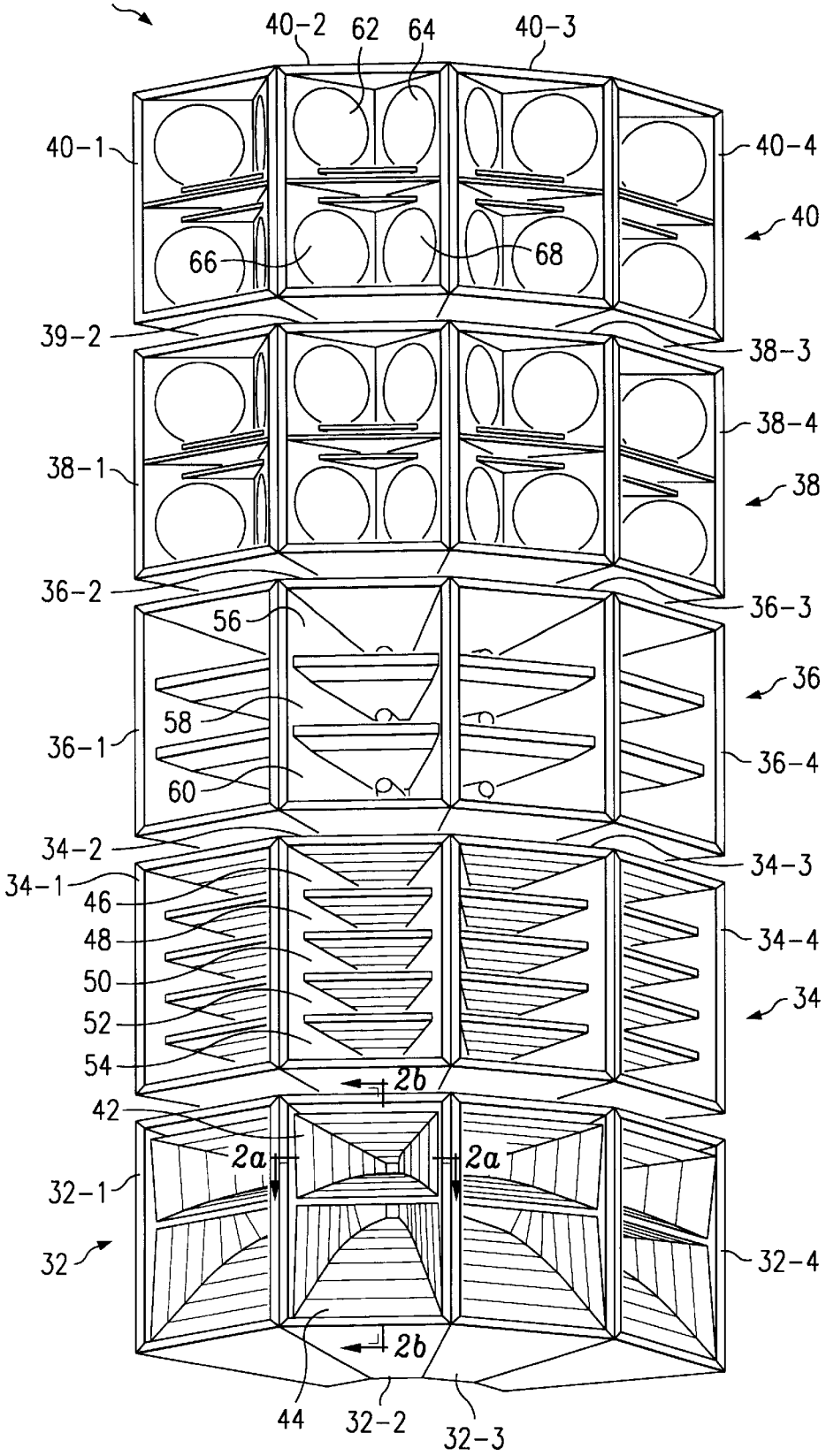
FIG. 1 is a front view of a speaker cluster.

Turning now to the drawings, in FIG. 1, reference numeral 30 designates a loudspeaker cluster system which forms part of a large scale sound reproduction system. By the term "large scale" sound reproduction system, it is intended to refer to sound reproduction systems suitable for use in a stadium or other large venue. For example, those sound reproduction systems capable of propagating appreciable sound levels, i.e. sound levels on the order of about 75–100 DB at a distance of about 300 feet would be considered to be a large scale sound reproduction system. Of course, the foregoing is but one example of performance characteristics of a large scale sound reproduction system. It should be clearly understood, however, that the invention would be suitable for use in other sound reproduction systems as well.

The loudspeaker cluster 30 is comprised of a down-fill loudspeaker module 32, a high-frequency range loudspeaker module 34, a mid-frequency range loudspeaker module 36 and first and second low-frequency range loudspeaker modules 38 and 40, stacked on top of each other in a generally vertical orientation. The loudspeaker cluster 30 is supportably mounted, for example, by a platform, cables or other support structure (not shown) generally parallel to, and approximately 20–30 feet above, the ground or other listening area. Each loudspeaker module 32, 34, 36, 38 and 40 is comprised of first, second, third and fourth loudspeaker cabinets 32-1 through 32-4, 34-1 through 34-4, 36-1 through 36-4, 38-1 through 38-4 and 40-1 through 40-4, each identically configured to each other and fixedly mounted to each other along a curved line to form the corresponding loudspeaker module 32, 34, 36, 38 or 40. As is more fully described in our co-pending patent application Ser. No. 08/962,425 filed Oct. 31,1997 entitled "Large Scale Sound Reproduction System having Cross-Cabinet Array of Horn Elements", frequencies above 300 Hz are directional in nature and, accordingly, the loudspeakers supportably mounted by each of the cabinets 32-1 through 32-4 of the down-fill loudspeaker module 32, each of the cabinets 34-1 through 34-4 of the high-frequency range loudspeaker module 34 and each of the cabinets 36-1 through 36-4 of the mid-frequency range loudspeaker module 36, respectively, provide 30 degrees of coverage along a horizontal plane of the stadium or other large venue. The loudspeakers supportably mounted by the cabinets 38-1 through 38-4 of the low frequency range loudspeaker module 38 and the cabinets 40-1 through 40-4 of the lower frequency range loudspeaker module 40 each provide omnidirectional coverage of varying magnitude throughout the stadium or other large venue.

As may be further seen in FIG. 1, each cabinet 32-1 through 32-4, 34-1 through 34-4, 36-1 through 36-4, 38-1 through 38-4 and 40-1 through 40-4 supportably mounts plural loudspeakers. For example, for the loudspeaker cluster 30 illustrated in FIG. 1, each cabinet 32-1 through 32-4 of the down-fill loudspeaker module 32, for example, the cabinet 32-2, supportably mounts a first loudspeaker 42 and a second loudspeaker 44 positioned below the first loudspeaker 42. Each cabinet 34-1 through 34-4, for example, the cabinet 34-2, of the high frequency range loudspeaker module 34 supportably mounts first, second, third, fourth and fifth loudspeakers 46, 48, 50, 52 and 54 arranged in a vertical array. Each cabinet 36-1 through 36-4, for example, the cabinet 36-2, of the mid-frequency range loudspeaker module 36 supportably mounts first, second and third loudspeakers 56, 58 and 60 arranged in a vertical array. Finally, each cabinet 38-1 through 38-4 and 40-1 through 40-4 of the first and second low-frequency range loudspeaker modules, for example, the cabinet 40-2, supportably mount first, second, third and fourth loudspeakers 62, 64, 66 and 68.

Figure 2A:
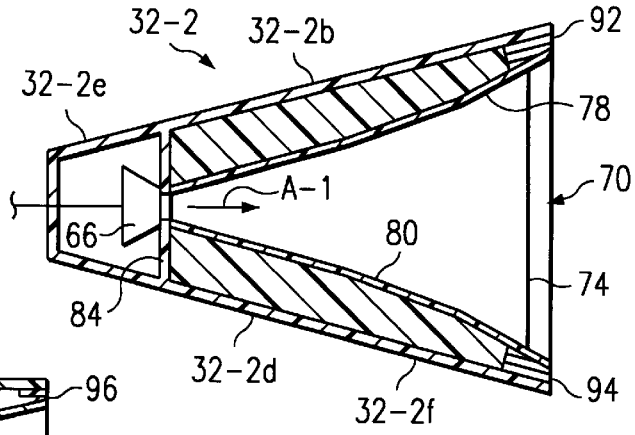
FIG. 2*a* is a cross-sectional view taken across lines 2*a*—2*a* of FIG. 1.
Figure 2B:
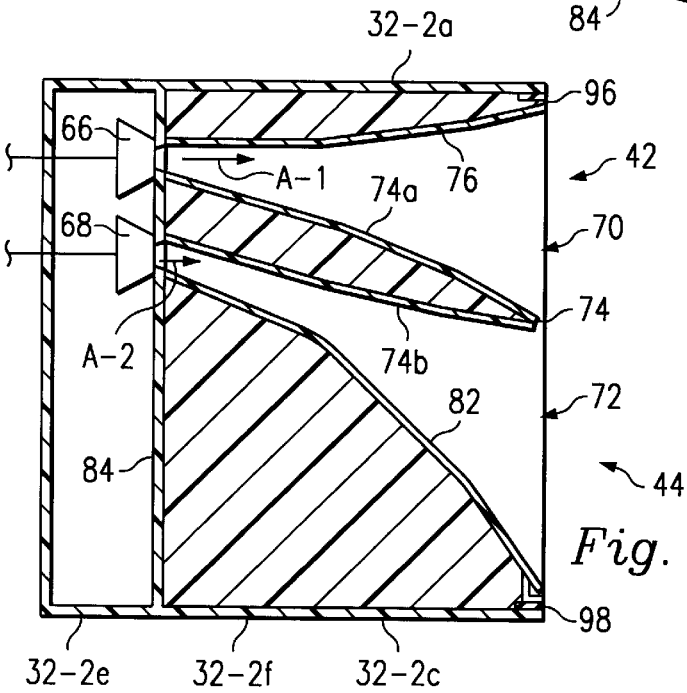
FIG. 2*b* is a cross-sectional view taken across lines 2*b*—2*b* of FIG. 1.

Turning next to FIGS. 2*a* and 2*b*, the down-fill loudspeaker module 32 will now be described in greater detail. For the down-fill loudspeaker module 32, each of the first, second, third and fourth cabinets 32-1 through 32-4 are identically configured. Accordingly, the internal configuration of only one of the down-fill cabinets, for example, the down-fill loudspeaker cabinet 32-2, need be described in detail. The down-fill loudspeaker cabinet 32-2 includes first and second loudspeakers arranged in a vertical array. As the upper and lower loudspeakers 42 and 44 are identically configured along the horizontal axis, only one horizontal cross-section, for example, across the horn 42, need be taken to describe the invention.

The first, or upper, loudspeaker 42 is comprised of a driver 66 coupled to a loudspeaker control system from which it receives an electrical signal used, by the driver 66, to generate an acoustic signal having selected characteristics and a horn 70 acoustically coupled to the driver 46. The horn 70 is defined by an interior side surface 76 of top wall 32*a*, an interior side surface 78 of a first part of a first side wall 32-2*b*, an upper side surface 74*a* of a separator wall 74 and an interior side surface 80 of a first part of a second side wall 32-2*d*.

Similarly, the lower loudspeaker is comprised of a driver 48 similarly coupled to the loudspeaker control system and a horn 52 acoustically coupled to the driver 48. The horn 52 is defined by an interior side surface 82 of bottom wall 32-2*c*, an interior side surface 80 of a second part of the second side wall 32-2*d*, a lower side surface 74*b* of the separator wall 74 and an interior side surface 78 of a second part of the first side wall 32-2*b*.

As may be best seen in FIG. 2*a*, the second down-fill cabinet 32-2 is further characterized by a generally trapezoidal cross-section along a horizontal axis thereof and, as best seen in FIG. 2*b*, a generally rectangular cross-section along a vertical axis thereof. As may be also seen in FIGS. 3*a–b*, the cabinet 32-2 may be divided into a rear portion 32-2R in which the drivers 66 and 68 are positioned and a front portion 32-2F in which the walls 32*a* through 32-2*d* and 74 which define the horns 70 and 72 are positioned. It should be clearly understood that, as the drivers 66 and 68 are schematically illustrated, FIGS. 2*a–b* do not accurately represent the relationship of the drivers 66 and 68 to the dimensions of the rear portion 32-2R. In fact, as is more full described in our co-pending U.S. patent application Ser. No. 08/962,425 filed Oct. 31,1997 entitled "Large Scale Sound Reproduction System having Cross-Cabinet Horizontal Array of Horn Elements", along the horizontal axis illustrated in FIG. 2*a*, the driver 66 fills most of the interior space of the rear portion 32-2R.

The front and rear portions 32-2F and 32-2R of the cabinet 32-2 are separated by an interior wall 84. To acoustically couple the drivers 66 and the horn 70, a first throat (not shown in FIGS. 2*a–b*) is formed in the interior wall 84. Similarly, to acoustically couple the driver 68 and the horn 72, a second throat (also not shown in FIGS. 2*a–b*) is also formed in the interior wall 84. Preferably, the first and second throats are formed along the interior wall 84 in the general center of the portion of the horn 70, 72 in communication therewith. Depending on the desired operational characteristics of the loudspeaker associated therewith, the shape of the throats will be variously selected. For example, depending on the desired acoustical propagation characteristics of the loudspeaker, the length and width of the throats may be variously selected. Purely by way of example, a generally circular-shaped throat having a diameter of about 2 inches will be suitable for the uses contemplated herein.

Figure 3A:
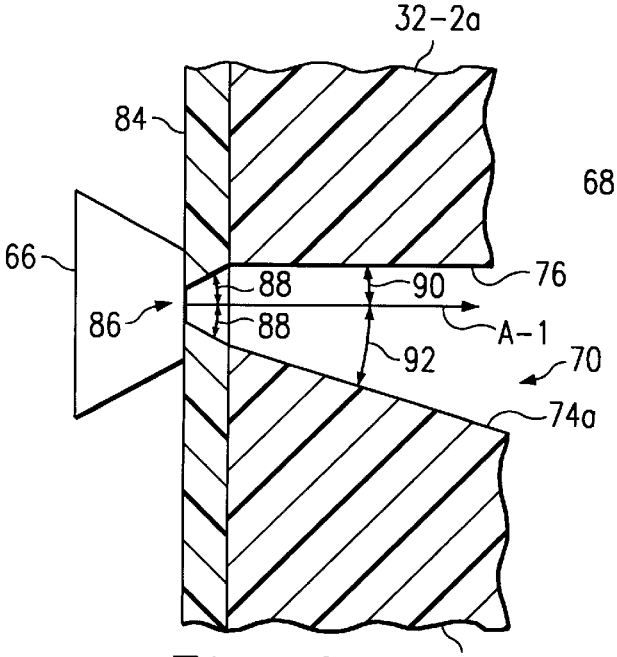
FIG. 3*a* is an enlarged view of a first portion of FIG. 2*b*.
Figure 3B:
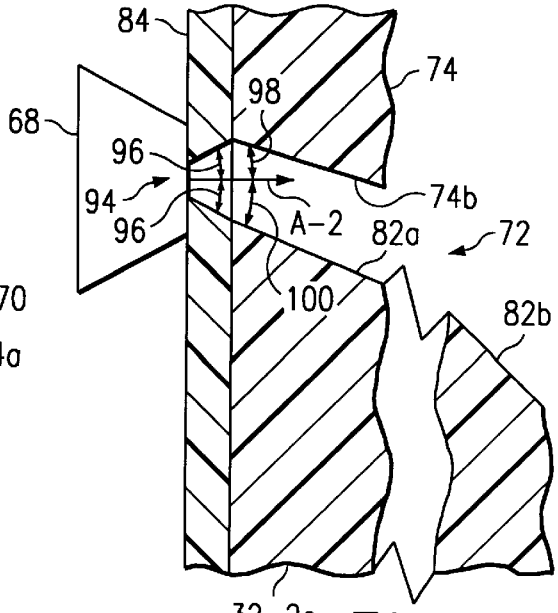
FIG. 3*b* is an enlarged view of a second portion of FIG. 2*b*.

Turning momentarily to FIGS. 3*a–b*, certain relational characteristics of the drivers 66 and 68, the interior wall 84, the throats and the interior surfaces of the walls 32*a* through 32-2*d* and 74 which define the horns 70 and 72 shall now be described. Axis A-1 of FIG. 3*a* (as well as axis A-2 of FIG. 3*b*) is generally orthogonal to the interior sidewall 84. Generally, a throat, for example, throat 86 shown in FIG. 3*a* or throat 94 shown in FIG. 3*b*, is angled as it extends through the interior wall 84 to acoustically couple the driver 66, 68 and the horn 70, 72. This angle is commonly referred to as a beam angle for the loudspeaker in that, for high frequency sound generated thereby, the beam angle controls coverage for acoustical signals propagating therefrom. Depending on the shape thereof, the throat 86, 94 may have multiple beam angles and FIGS. 3*a–b*, as illustrating the throats 86, 94 along a vertical axis thereof, respectively show vertical beam angle 88 for the throat 86 and vertical beam angle 96 for the throat 94.

Whether the horn 70, 72 has any effect on the acoustic signal being propagated from the throat 86, 94 depends on certain design parameters for both the walls 32-2*a*, 32-2*b*, 74 and 32-2*d*; 74, 32-2*b*, 32-2*c* and 32-2*d* which define the horn 70, 72 as well as the throat 86, 94 itself. More specifically, the interior side surface 76 of the top wall 32*a* has an angle of inclination 90 relative to the axis A-1 while the bottom side surface 74*b* of the separator wall 74 has an angle of inclination 98 relative to the axis A-2. If the beam angle 88 is less than the angle of inclination 90 for the interior side surface 76 of the top wall 32-2*a*, the acoustic signal generated by the drive 66 will not strike the interior side surface 76 of the top wall 32-2*a* and the horn 70 will have no effect on the acoustic signal generated by the driver 66. Similarly, if the beam angle 96 is less than the angle of inclination 98 for the bottom side surface 74*b* of the separator wall 74, the acoustic signal generated by the driver 68 will not strike the bottom side surface 74*b* of the separator wall 74 and the horn 72 will have no effect on the acoustic signal generated by the driver 68. For the vast majority of loudspeaker designs, the beam angle 88, 96 and the angle of inclination 90, 98 are closely matched and the interior side surface 76 of the top wall 32*a* and the bottom side surface 74*b* of the separator wall 74 act as simple waveguides for the acoustic signal generated by the driver 66, 68 and have minimal, if any impact on the coverage of the acoustic signal. Unlike conventional loudspeaker design, and in accordance with the teachings of the present invention, the horns 70 and 72 are both shaped such that the angles of inclination 90 and 96 are respectively less than the beam angles 88 and 96. Accordingly, a portion of the acoustic signals generated by the drivers 66 and 68 would be reflected downwardly at an angle of reflectance generally equal to the angle of incidence therefore. In fact, in accordance with a further aspect of the invention, the angles 90 and 96 of inclination are either about at or below 0 degrees, thereby limiting the loudspeakers 42 and 44 to down-fill coverage, i.e., coverage below the horizontal axes A-1, A-2.

A similar relationships exists between the beam angle 88 along the vertical axis and the angles of declination 92 for the separator wall 74. As before, if the beam angle 88 is less than the angle of declination 92, the acoustic signal generated by the driver 66 will never strike the interior side surface 74*a* of the separator wall 74 and, if the beam angle 88 is closely matched to the angle of declination, the interior side surface 74*a* acts as a waveguide for the acoustic signal generated by the driver 66. In accordance with the teachings of another aspect of the present invention, the angle of declination is greater than the beam angle over at least one portion of the bottom wall 32-2*c*. Specifically, while the angle of declination 100 for a first portion 82*a* of the interior side surface 82 of the bottom wall 32-2*c* is generally matched with the beam angle 96, the angle of declination 102 for a second portion 82*b* of the interior side surface 82 of the bottom wall 32-2*c* is greater than the beam angle 96. Thus, while the originally generated acoustic signal propagating from the driver 68 will never strike the second portion 82*b* of the interior side 82, the second portion 82*b* of the interior side surface 82 will permit down-fill acoustical coverage below the beam angle 96. Specifically, certain ones of the acoustical signals reflecting off of the bottom side surface 74*b*, will be reflected such that they pass below the original beam propagating away from the driver 68. As these reflected acoustical signals pass below the beam, they provide down-fill acoustical coverage over an area which otherwise would be missed by the acoustical signal propagating from the driver 68. Thusly, the area for which down-fill acoustical coverage is provided is controlled, in combination, by the relationship of the angle of inclination to the beam angle (which limits the amount of acoustical signal to be generated above the horizontal axis and the relationship of the beam angle to the angle of declination (which controls the amount of the acoustical signal which will propagate below the beam angle). Furthermore, by providing multiple horns, for example, the horns 70 and 72, with distinct configurations as to the aforementioned relationships, a single loudspeaker may provide substantial down-fill coverage below the horizontal axis.

Returning now to FIGS. 2*a–b*, the precise configuration of the horns 70 and 72 as to the aforementioned relationships shall now be described in greater detail. In the horizontal plane, the first and second side walls 32-2*b* and 32-2*d* extend outwardly from the mouth at about 30 degrees off on opposite sides of axis A-1. Each of the first and second side walls 32-2*b* and 32-2*d* include a first, essentially straight, portion and a second, slightly tapered, portion. The essentially straight first portion extends from the throat to about the mid-point of the first and second side walls 32-2*b* and 32-2*d*. The slightly tapered second portions extends from the mid-point of the first and second side walls 32-2*b* and 32-2*d* to front edges 92 and 94 thereof. The taper of each of the first and second side walls 32-2*b* and 32-2*d* is about 30 degrees. Further details as to the advantages achieved by forming the first and second side walls 32-2*b* and 32-2*d* of the horn 50 are set forth in greater detail in co-pending U.S. Patent Application Serial No. 08/962,425 filed Oct. 31,1997 entitled "Large Scale Sound Reproduction System having Cross-Cabinet Horizontal Array of Horn Elements."

In the vertical plane, the horn 50 is defined by the interior side surface of the top wall 32-2*a* and the top side surface 74*a* of the separator wall 74. The interior side surface 76 of the top wall 32-2*a* has a slight upward taper and an angle of inclination of about 0 degrees, the throat has a beam angle of about 15 degrees while the top side surface 74*a* of the separator wall 74 has a slight downward taper generally equal in magnitude and opposite in orientation to the taper of the interior side surface 76 of the top wall 32-2*a*. The separator wall 74 itself, however, has an angle of declination of about 15 degrees. The horn 52, on the other hand, is defined in the vertical plane by the bottom side surface 74*b* of the separator wall 74 and the interior side surface 82 of the bottom wall 32-2*c*. The bottom side surface 74*b* of the separator wall 74 is essentially straight along the predominant portion of its length with, of course, the aforementioned minor tapering at an end portion thereof. Thus, the angle of inclination for the bottom side surface 74*b* of the separator wall 74 is about −15 degrees while the throat 94 has a beam angle of about 30 degrees. The interior side surface 82 of the bottom wall 32-2*c* includes a first portion 82*a* which is roughly parallel with the bottom side surface 74*b* of the separator wall 74 (and has, therefore, an angle of declination of about 15 degrees) and a second portion 82*b* characterized by an angle of declination of about 45 degrees. Finally, the first and second portions 82*a* and 82*b* are approximately of the same length.

The loudspeakers disclosed herein rely on their unique shapes, in combination with certain principles of reflection, in order to operate as down-fill loudspeakers. More specifically, the top walls of the horn portions thereof are shaped, relative to the beam angle of the acoustic signal generated thereof, such that little, if any, acoustical signal travels above the horizontal axis of the loudspeaker while the bottom wall of the lowermost one of the horn portions is shaped such that part of the acoustic signal generated by the driver associated therewith is reflected downward where it provides down-fill coverage for areas below the beam angle of the generated acoustic signal. By providing a loudspeaker having the aforementioned relationships between various components thereof, a loudspeaker having a generally rectangular cross-section along a horizontal axis thereof and having horns which only open along a front side surface thereof may be mounted generally parallel to the horizontal plane, i.e., the ground of a stadium or other venue, as part of an elevated loudspeaker cluster while still providing down-fill coverage for the loudspeaker cluster.

Although illustrative embodiments of the invention have been shown and described, other modifications, changes, and substitutions are intended in the foregoing disclosure. For example, the beam angle, angle of inclination and angle of declination for a loudspeaker may be modified to shift the area for which down-fill coverage is provided. Alternately, or in combination therewith, a cabinet may be designed to support more than two down-fill loudspeakers, thereby providing down-fill coverage for a greater number of areas. Accordingly, it is appropriate that the appended claims be construed broadly and in a manner consistent with the scope of the invention.

What is claimed is:

1. A down-fill speaker, comprising:

a cabinet having top, bottom, first side and second side walls;

a loudspeaker supportably mounted in said cabinet, said loudspeaker configured to generate a high frequency acoustic signal having a vertical beam angle having upper and lower bounds;

said top, bottom, first side and second side walls having respective interier side surfaces which define a horn for said loudspeaker;

said interior side surface of said top wall having an angle of inclination and said interior side surface of said bottom wall having an angle of declination;

said upper bound of said vertical beam angle being greater than said angle of inclination for said top wall and said angle of declination for said bottom wall being greater than said lower bound of said vertical beam angle;

wherein a portion of said generated acoustic signal which extends between said angle of inclination and said upper bound of said vertical beam angle reflects off said interior side surface of said top wall to provide down-fill acoustical coverage for an area located below said lower bound of said vertical beam angle for said generated acoustic signal.

2. A down-fill speaker according to claim 1 wherein said top and bottom walls further comprises respective front edges and wherein said front edges of said top and bottom walls are positioned in a plane generally orthogonal to said top and bottom walls.

3. A down-fill speaker comprising:

a cabinet having top, bottom, first side and second side walls;

a loudspeaker supportably mounted in said cabinet, said loudspeaker configured to generate a high frequency acoustic signal having a vertical beam angle;

said top, bottom, first side and second side walls having respective interior side surfaces which define a horn for said loudspeaker;

said interior side surface of said top wall having an angle of inclination and said interior side surface of said bottom wall having an angle of declination;

said vertical beam angle being greater than said angle of inclination for said top wall and said angle of declination for said bottom wall being greater than said vertical beam angle;

wherein a portion of said generated acoustic signal reflects off said interior side surface of said top wall to provide down-fill acoustical coverage for an area located below said beam angle for said generated acoustic signal; and wherein said interior side surfaces of said top and bottom walls are shaped to reflect said acoustical signal about 30 degrees below said vertical beam angle of said acoustic signal.

4. A down-fill speaker according to claim 3 wherein:

said angle of inclination for said top wall is about −15 degrees;

said angle of declination for said bottom wall being about 15 degrees along a first portion thereof and said angle of declination for said bottom wall being about 45 degrees along a second portion thereof.

5. A down-fill speaker, comprising:

a cabinet having a generally rectangular cross-section along a vertical axis thereof; and at least one loudspeaker supportably mounted in said cabinet, each said loudspeaker having a horizontal axis and configured to generate a high frequency acoustic signal having a vertical beam angle which extends between upper and lower bounds;

said cabinet including walls having interior side surfaces which define a horn for each one of said at least one loudspeaker;

said interior side surfaces of said cabinet shaped to direct audible sound signals generated by said at least one loudspeaker below said lower bound of said vertical beam angle of said at least one loudspeaker by reflecting said audible sound signals off selected ones of said interior side surfaces.

6. A down-fill speaker according to claim 5 wherein said down-fill speaker further comprises first and second loudspeakers arranged in a vertical array.

7. A down-fill speaker according to claim 6 wherein said interior side surfaces of said cabinet define a first horn for said first loudspeaker and a second horn for said second loudspeaker.

8. A down-fill speaker according to claim 7 wherein said first horn is shaped to direct audible sound signals to a first down-fill coverage area and said second horn is shaped to direct audible sound signals to a second down-fill coverage area.

9. A down-fill speaker according to claim 7 wherein said cabinet further comprises a separator wall which separates said first horn of said first loudspeaker from said second horn of said second loudspeaker.

10. A down-fill speaker according to claim 9 wherein said separator wall is angled at least about 15 degrees below said horizontal axis of said vertical array of loudspeakers.

11. A down-fill speaker system according to claim 9 wherein said separator wall has a tapered top side surface which defines a bottom wall for said first horn of said first loudspeaker and an oppositely tapered bottom side surface which defines a top wall for said second horn of said second loudspeaker.

12. A down-fill speaker according to claim 11 wherein said vertical beam angle is centered along said horizontal axis and wherein said separator wall is angled at least about 15 degrees below said horizontal axis of said vertical array of loudspeakers.

13. A down-fill speaker according to claim 12 wherein said interior side surfaces of said walls further defines a bottom wall for said second horn for said second loudspeaker, said bottom wall characterized by a first section generally parallel with said bottom side surface of said separator wall and a second section angled approximately 30 degrees away from said bottom side surface of said separator wall.

14. A down-fill speaker according to claim 13 wherein said first and second sections of said interior wall which defines said bottom wall for said second horn have approximately the same length.

15. A down-fill speaker according to claim 5 wherein said cabinet has a generally trapezoidal cross-section along a horizontal axis thereof.

16. A down-fill speaker, comprising:

a cabinet having a generally rectangular cross-section along a vertical axis thereof; and a loudspeaker supportably mounted in said cabinet, said loudspeaker configured to generate a high frequency acoustic signal having a vertical beam angle;

said cabinet having top, bottom, first side and second side walls, each having interior side surfaces thereof, which collectively define a horn for said loudspeaker;

said top wall being generally parallel with, and said bottom wall having a downward shift of about 15 degrees, respectively, relative to a common horizontal axis of said loud speaker;

said vertical beam angle centered along said common horizontal axis of said loudspeaker and having upper and lower bounds;

wherein, as acoustic signals above said horizontal axis are reflected off of said interior side surface of the top wall, said down-fill speaker provides down-fill coverage below said lower bound of said vertical beam angle.

17. A down-fill speaker according to claim 16 wherein said interior side surface of said top wall and said interior side surface of said bottom wall having oppositely orientated tapers of generally equal magnitude.

18. A down-fill speaker, comprising:

a cabinet having a generally rectangular cross-section along a vertical axis thereof; and a loudspeaker supportably mounted in said cabinet, said loudspeaker configured to generate a high frequency acoustic signal having a vertical beam angle having upper and lower bounds;

said cabinet having top, bottom, first side and second side walls, each having interior side surfaces thereof, which collectively define a horn for said loudspeaker;

said interior side surface of said top wall having an angle of inclination less than said vertical beam angle;

said interior side surface of said top wall being substantially parallel to said interior side surface of said bottom wall along a first portion of said bottom wall;

said interior side surface of a second portion of said bottom wall being downwardly angled about 30 degrees relative to said interior side surface of said first portion of said bottom wall;

wherein acoustic signals generated by said loudspeaker and reflected off of said interior side surface of said top wall provide down-fill coverage below said lower bound of said vertical beam angle for said down-fill speaker.

19. A down-fill speaker, comprising:

a cabinet having a generally rectangular cross-section along a vertical axis thereof;

an upper loudspeaker supportably mounted in said cabinet;

a lower loudspeaker supportably mounted in said cabinet;

said cabinet having top, intermediate, bottom, first side and second side walls, said top, bottom, first side and second side walls each having an interior side surface thereof and said intermediate wall having first and second interior side surfaces;

said interior side surfaces of said top wall, said interior side surface of a first portion of said first side wall, said first interior side surface for said intermediate wall and said interior side surface of a first portion of said second side wall collectively defining a horn for said upper loudspeaker;

said second interior side surface of said intermediate wall, said interior side surface of a second portion of said first side wall, said interior side surface of said bottom wall and said interior side surface of a second portion of said second side wall collectively defining a horn for said lower loudspeaker;

said interior side surface of said top wall being generally parallel with, and said intermediate wall being positioned about 15 degrees below, a horizontal axis;

said second interior side surface of said intermediate wall being substantially parallel to said interior side surface of said bottom wall along a first portion of said bottom wall;

said interior side surface of a second portion of said bottom wall being downwardly angled about 30 degrees relative to said interior side surface of said first portion of said bottom wall;

wherein, as acoustic signals generated by said upper loudspeaker above said horizontal axis are reflected off of said interior side surface of said top wall, said upper loudspeaker provides down-fill coverage for a first area and wherein, as acoustic signals generated by said lower loudspeaker are reflected off of said second interior side surface of said intermediate wall, said lower loudspeaker provides down-fill coverage for a second area.

20. A down-fill speaker for providing acoustical coverage for an area below a generally horizontal axis, comprising:

a cabinet having top, bottom, first side and second side walls, each of said top, bottom, first side and second side walls having respective interior and exterior side surfaces;

said exterior side surface of said top and bottom walls being generally parallel with said generally horizontal axis;

a loudspeaker supportably mounted in said cabinet, said loudspeaker configured to generate a high frequency acoustic signal having a beam angle centered on said generally horizontal axis and extending from an upper bound above said generally horizontal axis to a lower bound below said generally horizontal axis;

said interior side surfaces of said top, bottom, first side and second side walls defining a horn for said loudspeaker;

said interior side surface of said top wall having an angle of inclination and said interior side surface of said bottom wall having an angle of declination;

wherein a portion of said acoustic signal having a beam angle between said angle of inclination and said upper bound of said loudspeaker beam angle is reflected off of said interior side surface of said top wall to provide down-fill acoustical coverage for an area below said lower bound of said loudspeaker beam angle.

* * * * *